United States Patent [19]

Kankkunen

[11] Patent Number: 4,674,970

[45] Date of Patent: Jun. 23, 1987

[54] RAM CASTING MACHINE FOR CONCRETE SLABS

[75] Inventor: Heikki I. Kankkunen, Forssa, Finland

[73] Assignee: Rakennusvalmiste Oy, Forssa, Finland

[21] Appl. No.: 773,532

[22] Filed: Sep. 9, 1985

[30] Foreign Application Priority Data

Sep. 10, 1984 [FI] Finland ..... 843545

[51] Int. Cl.[4] ..... B28B 21/52; B28B 3/22

[52] U.S. Cl. ..... 425/381; 366/332; 425/447; 425/456; 425/457

[58] Field of Search ..... 425/380, 381, 62, 63, 425/378 R, 457, 447, 456, 469, 466; 366/96, 332, 98

[56] References Cited

U.S. PATENT DOCUMENTS

| | | | |
|---|---|---|---|
| 2,748,442 | 6/1956 | Butcher | 425/380 |
| 3,176,494 | 4/1965 | Cullen et al. | 425/381 |
| 3,205,534 | 9/1965 | Langecker | 425/466 |
| 3,209,404 | 10/1965 | Hagen | 425/466 |
| 3,877,860 | 4/1975 | Putti | 425/380 |
| 3,909,183 | 9/1975 | Hsu | 425/466 |
| 3,932,102 | 1/1976 | Rosenbaum | 425/466 |
| 4,444,702 | 4/1984 | Thomas et al. | 425/381 |
| 4,547,142 | 10/1985 | Arenhövel et al. | 425/378 R |

*Primary Examiner*—Willard E. Hoag

*Attorney, Agent, or Firm*—Birch, Stewart, Kolasch & Birch

[57] ABSTRACT

A ram casting machine for the fabrication of concrete slabs which is movable on a casting bed. The machine incorporates a feed hopper and a concrete flow channel with ram numbers cyclically reciprocated therein in opposite directions for generating internal pressure in the cast concrete. Each ram member including at least one wedge-shaped surface assembly having first and second inclined annular surfaces, with the entrance to the concrete flow channel and having a steeper inclination than the second inclined annular surface.

4 Claims, 4 Drawing Figures

RAM CASTING MACHINE FOR CONCRETE SLABS

The present invention relates to a ram casting machine for casting concrete slabs.

In the prior art there exist concrete slab extruders which fabricate hollow-cored concrete slabs by auger flight feeds accompanied by initial forming members. Generally, these machines are movable on a casting bed by support wheels, and in their construction the final die members surround the augers and the initial forming members to give the core the desired cross-section. Vibration, ram compaction, or a combination of both is used for compacting concrete in these machines. A characteristics feature of these machines is that they use a concrete mix stiff enough to keep the slab in shape on the casting bed without further support.

However, the prior art methods and equipment have the following disadvantages.

The forming and compaction of a stiff concrete mix at the auger flight exit end into the desired form requires high pressure, heavy vibration or compaction, or a combination of both. Consequently, the power required for slab casting is extremely high when compared to the result achieved. This applied excess power causes heavy wear on those parts of the auger assemblies which form the slab core, necessitating the use of expensive materials and resulting in a short life for the parts. In addition, the noise level is excessively high. The aim of the present invention is to provide machinery that overcomes the aforementioned disadvantages.

More specifically, the ram casting machine in accordance with the invention includes at least two ram members which are cyclically reciprocated in opposite directions.

The ram casting machine in accordance with the present invention has remarkable advantages. For example, the ram casting machine according to the invention can be used for casting concrete slabs from an extremely stiff concrete mix by a continuous casting method. The invention is especially applicable to the fabrication of hollow-cored concrete slabs, though it can also be used for casting voluminous concrete products by a continuous casting method in which the ram-action compacted concrete is subjected to a shear-action under the casting chamber pressure, resulting in good compaction. During the shear and ramming action, the concrete is fed into the flow channel to form the desired cross-section.

Moreover, the invention facilitates the fabrication of lighter and higher hollow-cored slabs and other continuous-cast profiles than previously, in addition to the ability to use lightened slab constructions for low-profile hollow-cored slabs. This arrangement uses a smaller number of expensive auger units and consumable parts per manufactured unit.

In the following, the invention will be set forth in more detail by means of the exemplifying embodiments in accordance with the attached drawings.

Figure 1:
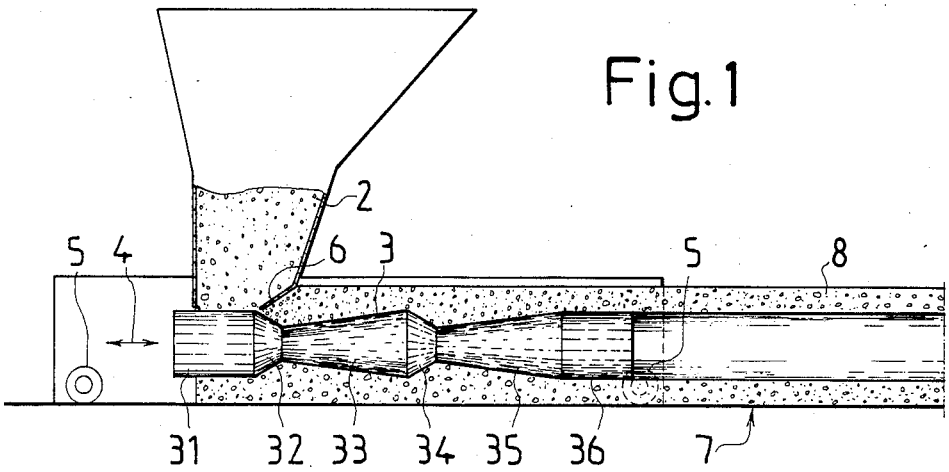
FIG. 1 shows a side view of an embodiment of a ram casting machine in accordance with the invention.
Figure 2:
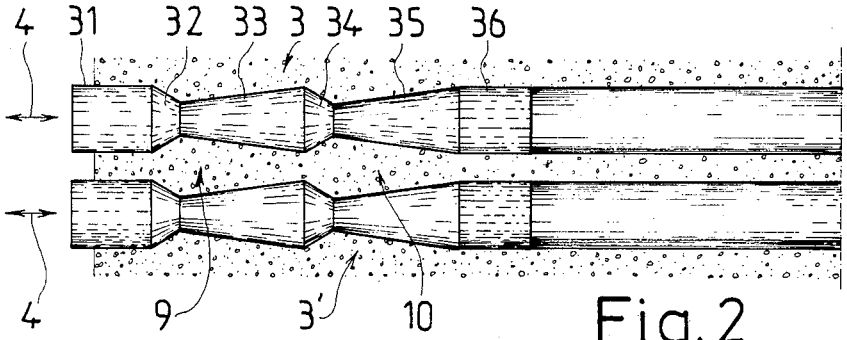
FIG. 2 shows in a top view the shear-action ram element of the machine referred to in FIG. 1.

The ram casting machine shown in FIGS. 1 and 2 is movable on support wheels 5, and the concrete mix is fed by the cyclic longitudinal movement 4 of elongated ram members or shear-action rams 3, 3'. When the concrete mix falls down from a feed hopper 2, a lip 6 at the lower end of the shoot 2 prevents a reflow of concrete back to the feed hopper. The full compaction of the concrete, however, is obtained first in the shear-action channel between the properly formed shear-action rams 3. The compaction is achieved in the pressurized space by the shear-action compaction method without high-frequency vibration.

Figure 3:
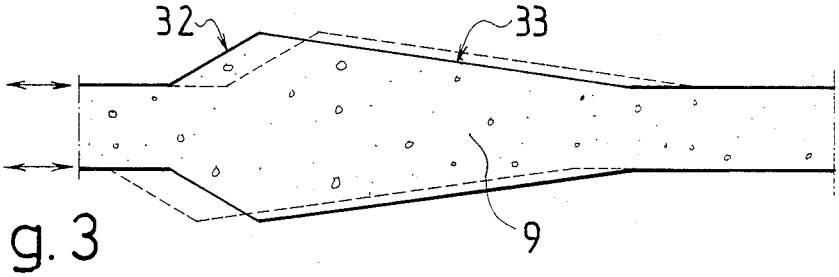
FIG. 3 shows schematically the compaction operation of a shear-action ram channel.

FIG. 3 shows in detail the operation of the shear-action channel 9 formed between the shear-action rams 3, 3'. The rams are so formed that they are more steeply tapered at the entrance end. In this regard, the surfaces 32, 34 are steeper than the surfaces 33, 35. When the shear-action rams 3 make their cyclic movement in a synchronized manner in opposite directions, the steeper surface 32, 34 forces the concrete is flow forward towards the exit end of the machine into the concrete flow channel. The steeper surface 32, 34 generates a ram-action compacting effect, disposing with a separate ram piston.

Consequently, the form of the shear-action ram 3 incorporates a ramming component, but perhaps the most important feature for compacting a stiff concrete mix is the shear-action of the ram 3. When the spaces between the core-forming rams 3 are, e.g., diamond-shaped, and the rams 3 are moving in a synchronized manner in opposite directions, the concrete cannot move steadily but is sheared in it entire length in the midrange of the shearing space. An especially important factor is that the shear-action channel 9 is relatively long, allowing the shear-action to take place on a sufficiently long distance to achieve as efficient compaction as possible.

The shear-action channels 9, 10 can be constructed in series, depending on the cross-section thickness. Generally, the shear-action channels 9, 10 are constructed so that the compaction takes place on a longer distance in phases. Thus the shear-action is stronger at the entrance end than at the exit end. This facilitates a remarkable compaction degree and high casting speed.

Naturally, the scope of the invention allows using only one shear-action ram of the aforementioned type.

Figure 4:
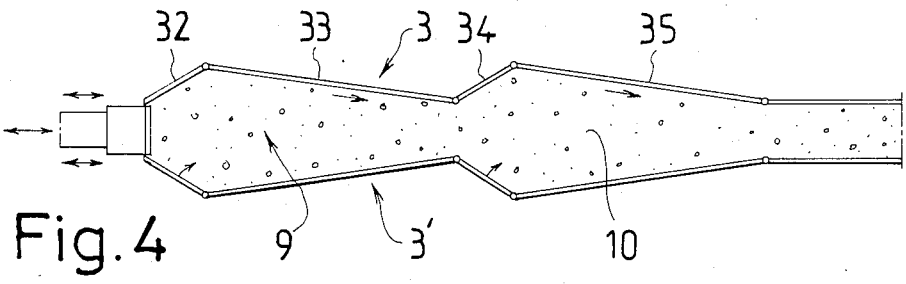
FIG. 4 shows in a top view and partially schematically another embodiment of the machine in accordance with the invention.

FIG. 4 shows an alternative embodiment of the machine according to the invention. This machine construction is especially applicable to the fabrication of very massive concrete products. The mold sides 3 and 3' in the machine are moving in a synchronized manner in opposite directions. The ramming components in this constructon are complemented with a ram piston 11.

What is claimed is:

1. A ram casting machine, movable on a casting bed, for casting concrete slabs comprising a concrete flow channel having a longitudinal direction, an entrance end and an exit end, a feed hopper located at said entrance end, at least two elongated ram members aligned in said longitudinal direction in said concrete flow channel, each said ram member being provided with at least one annular coaxial groove having a wedge-shaped profile in said longitudinal direction of said ram member formed by a first inclined annular surface and a second inclined annular surface, said first inclined annular surface being nearer to said concrete flow channel entrance than said second inclined annular surface, said first inclined annular surface having a steeper inclination than said second inclined surface, means for cyclically reciprocating said ram members in said longitudinal direction such that adjacent ram members are travelling in opposite directions at any given time, and said wedge-shaped profiles of adjacent ram members are aligned in the longitudinal direction so that a space is formed therebetween in which the cyclic movement of the members generates a simultaneous shear and compaction of the concrete mix.

2. A ram casting machine as claimed in claim 1, wherein said ram members each terminates, at said exit end of said concrete flow channel, in a core-forming portion.

3. A ram casting machine as claimed in claim 1, wherein said first inclined annular surface has the shape of a blunt truncated cone and said second inclined annular surface has the shape of a narrow truncated cone.

4. A ram casting machine as claimed in claim 1, wherein said ram members each has a plurality of said first inclined annular surfaces and a plurality of said second inclined surfaces alternating therewith.

* * * * *

Notice of Adverse Decision in Interference

In Interference No. 101,915, involving Patent No. 4,674,970, H. I. Kankkunen, RAM CASTING MACHINE FOR CONCRETE SLABS, final judgment adverse to the patentee was rendered Nov. 23, 1988, as to claims 1 - 4.

[*Official Gazette February 14, 1989.*]